US008769899B2

(12) United States Patent
Barry et al.

(10) Patent No.: US 8,769,899 B2
(45) Date of Patent: Jul. 8, 2014

(54) ATTIC PLATFORM

(75) Inventors: John Barry, Kenmare (IE); Niall Lehane, Killarney (IE)

(73) Assignee: Barry & Lehane Architectural Limited, County Kerry (IE)

( * ) Notice: Subject to any disclaimer, the term of this patent is extended or adjusted under 35 U.S.C. 154(b) by 0 days.

(21) Appl. No.: 13/004,194

(22) Filed: Jan. 11, 2011

(65) Prior Publication Data

US 2011/0283644 A1 Nov. 24, 2011

(30) Foreign Application Priority Data

May 21, 2010 (GB) ..... 1008493.7

(51) Int. Cl.
*E04B 9/00* (2006.01)
*E04B 5/43* (2006.01)
*E04B 1/38* (2006.01)

(52) U.S. Cl.
CPC .... *E04B 5/43* (2013.01); *E04B 1/38* (2013.01)
USPC ..... 52/480; 52/578

(58) Field of Classification Search
CPC ..... E04F 15/02452; E04F 15/02405; E04B 5/02; E04B 5/43; E04B 1/38
USPC ..... 52/480, 578, 407.3, 407.5, 126.6, 263; 211/86.01, 188
See application file for complete search history.

(56) References Cited

U.S. PATENT DOCUMENTS 1,730,618 A * 10/1929 Mayo ..... 254/104
1,838,589 A * 12/1931 Stuebing, Jr. ..... 108/56.3
3,318,057 A * 5/1967 Norsworthy ..... 52/126.6
3,436,881 A * 4/1969 Schlecht ..... 52/91.3
3,686,804 A * 8/1972 Browne ..... 52/31
3,854,269 A * 12/1974 Hancock ..... 220/683
4,063,839 A * 12/1977 Brown ..... 404/69
4,185,433 A * 1/1980 Cantrell ..... 52/94
4,292,777 A * 10/1981 Story ..... 52/407.1
4,631,878 A * 12/1986 Laramore ..... 52/90.2
4,836,393 A * 6/1989 Maye ..... 211/188
4,879,856 A * 11/1989 Jones et al. ..... 52/403.1
4,989,826 A * 2/1991 Johnston, Jr. ..... 248/676
5,058,352 A * 10/1991 Loiselle et al. ..... 52/404.2
5,197,251 A * 3/1993 Krysak ..... 52/407.3
5,239,790 A * 8/1993 Fetzer ..... 52/36.4
5,275,367 A * 1/1994 Frye ..... 248/205.3
5,351,926 A * 10/1994 Moses ..... 248/354.5
5,406,895 A * 4/1995 Suess ..... 108/149
5,628,153 A * 5/1997 Fontanez ..... 52/39
5,638,914 A * 6/1997 Kizzia ..... 182/45

(Continued)

FOREIGN PATENT DOCUMENTS

GB 2438620 A 12/2007
GB 2468674 A 9/2010
WO 2011/110848 A1 9/2011

*Primary Examiner* — William Gilbert
*Assistant Examiner* — James Ference
(74) *Attorney, Agent, or Firm* — Blank Rome LLP

(57) ABSTRACT

Apparatus for providing a platform area in an attic having a plurality of generally parallel joists 4, the apparatus comprising a plurality of legs 33, each leg having a joist mounting 43 at one end and a platform support 45 at, or in the region of, the opposite end, and a plurality of boards 35, the apparatus being arranged, in use, to provide a raised platform over adjacent joists with boards mounted on legs connected to different joists.

12 Claims, 16 Drawing Sheets

(56) References Cited

U.S. PATENT DOCUMENTS

| | | | | |
|---|---|---|---|---|
| 5,746,139 | A * | 5/1998 | Villanueva | 108/92 |
| 5,799,461 | A * | 9/1998 | Dittemore | 52/588.1 |
| 5,806,270 | A * | 9/1998 | Solano et al. | 52/747.11 |
| 5,816,554 | A * | 10/1998 | McCracken | 248/346.01 |
| 5,888,017 | A * | 3/1999 | Corrie | 404/64 |
| 6,694,689 | B1 * | 2/2004 | Scott et al. | 52/392 |
| 7,360,343 | B1 * | 4/2008 | Spransy et al. | 52/263 |
| 7,389,614 | B2 * | 6/2008 | Sullivan | 52/202 |
| 7,591,105 | B2 * | 9/2009 | Balser | 52/29 |
| 7,610,728 | B1 * | 11/2009 | Manocchia | 52/299 |
| 7,617,641 | B2 * | 11/2009 | Landey | 52/177 |
| 7,874,114 | B2 * | 1/2011 | Snyder | 52/407.3 |
| 8,015,761 | B2 * | 9/2011 | Wainland | 52/177 |
| 2001/0029718 | A1 * | 10/2001 | Snyder et al. | 52/474 |
| 2002/0095895 | A1 * | 7/2002 | Daly et al. | 52/464 |
| 2002/0148173 | A1 * | 10/2002 | Kugler | 52/126.6 |
| 2003/0177706 | A1 * | 9/2003 | Ullman | 52/3 |
| 2003/0192278 | A1 * | 10/2003 | Snyder et al. | 52/474 |
| 2003/0196402 | A1 * | 10/2003 | Roen | 52/507 |
| 2004/0035064 | A1 * | 2/2004 | Kugler et al. | 52/126.6 |
| 2004/0261329 | A1 * | 12/2004 | Kugler et al. | 52/126.6 |
| 2005/0016098 | A1 * | 1/2005 | Hahn | 52/384 |
| 2006/0075711 | A1 * | 4/2006 | Landey | 52/506.06 |
| 2006/0192069 | A1 * | 8/2006 | Attaway | 248/351 |
| 2006/0277832 | A1 * | 12/2006 | Balser | 52/29 |
| 2006/0283117 | A1 * | 12/2006 | Williams et al. | 52/393 |
| 2007/0028550 | A1 * | 2/2007 | Clapper | 52/650.3 |
| 2008/0134608 | A1 | 6/2008 | Snyder | |
| 2008/0191110 | A1 * | 8/2008 | Wainland | 248/226.11 |
| 2008/0245280 | A1 * | 10/2008 | Wainland | 108/153.1 |
| 2009/0090279 | A1 * | 4/2009 | Wainland | 108/42 |
| 2009/0282766 | A1 * | 11/2009 | Roen | 52/506.08 |
| 2010/0133216 | A1 | 6/2010 | Lanza-Brache et al. | |

* cited by examiner (a)

(b)

(a)

(b)

ATTIC PLATFORM

CROSS-REFERENCE TO RELATED APPLICATIONS

The present application claims priority to United Kingdom GB1008493.7 filed May 21, 2010, the entire disclosures are incorporated by reference herein.

FIELD OF THE INVENTION

This invention relates to apparatus for providing a raised platform area in an attic having a plurality of generally parallel joists. The invention also relates to a method of constructing the same.

BACKGROUND OF THE INVENTION

Referring to FIG. 1, it is common to lag or insulate the attic or loft space of a building by laying an insulation material 2, usually a mineral wool, between the parallel joists 4. It is also known to add a further layer of insulation in the transverse direction to further reduce heat loss. A problem with adding this further layer is that it is no longer clear where the underlying joists are, and, therefore where it is safe to store items or walk on. Thus, there exists the danger that items and people could fall through the plasterboard between the joists.

SUMMARY OF THE INVENTION

According to the invention, there is provided apparatus for providing a platform area in an attic having a plurality of generally parallel joists, the apparatus comprising a plurality of legs, each leg having a joist mounting at one end and a platform support at, or in the region of, the opposite end, and a plurality of boards, the apparatus being arranged, in use, to provide a raised platform over adjacent joists with boards mounted on legs connected to different joists.

The apparatus may further comprise a plurality of longitudinal arms, wherein each leg further comprises an arm mounting arranged such that an arm can be connected to extend between two or more legs on respective joists.

The arm mounting can be adjacent the level of the platform support in order that the arm may provide underlying support to an overlying board across the inter-joist space.

The arm mounting may comprise an aperture, recess or niche and the arm may have sufficient length to span two or more inter-joists spaces by means of passing through the aperture, recess or niche of an intermediate leg.

The arm mounting of each leg can be arranged such that the connected arm extends substantially transverse to the direction of the joists.

Each longitudinal arm may comprise a tongue portion protruding upwards along at least part of its length in order to engage a groove formed in a board supported above.

Each longitudinal arm may support two boards at or in the region of their interface, the tongue portion engaging a groove formed along the edge of each board extending transverse to the direction of the joists.

Each leg may further comprise a spar mounting arranged generally parallel to the direction of the joists, and into which a longitudinal spar can be connected to provide additional underlying support to an overlying board or boards.

The joist mounting of each leg may comprise a pair of resilient jaws. The jaws can be provided by upwardly projecting tabs within a U-shaped clamp. The joist mounting can further comprise means for screwing or bolting the joist mounting to a joist.

The joist mounting and platform support may be provided as separate components separated by a longitudinal post, for example a wooden, plastics or metal post. In the case of a plastics or metal post, its cross section could be circular or, as is the preferred case here, generally rectangular with concave sides.

According to a second aspect, there is provided apparatus for providing a raised platform in an attic having a plurality of generally parallel joists, the apparatus comprising a set of components made up of (i) legs for connection to underlying joists, (ii) arms for connection between legs on different joists, and (iii) boards for laying over the framework provided by the interconnected legs and arms.

According to a third aspect, there is provided apparatus for providing a raised platform in an attic having a plurality of generally parallel joists, the apparatus comprising a plurality of legs and a plurality of boards, each leg having at one end a joist mounting portion for connection to an underlying joist, and at, or in the region of, the other end, a support portion for supporting one or more boards, wherein the leg support portion and boards are engaged by means of a tongue and groove arrangement extending generally transverse to the direction of the joists.

The joist mounting portion may be a U-shaped channel extending generally transverse to the orientation of the tongue and groove arrangement.

BRIEF DESCRIPTION OF THE DRAWINGS

The invention will now be described, by way of example, with reference to the accompanying drawings in which.

DETAILED DESCRIPTION OF A PREFERRED EMBODIMENT

A first embodiment of the invention will be described with reference to FIGS. 2 to 11. In this first embodiment, a raised platform for covering an additional layer of insulating material is constructed using a plurality of components made up of two types, namely a leg 8 and a rectangular board 20.

Figure 1:
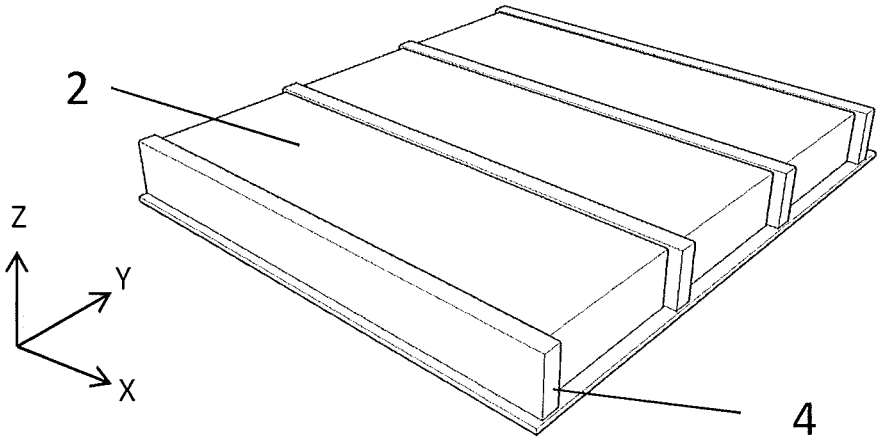
FIG. 1 is a perspective diagram of an attic space with insulation laid between parallel joists.
Figure 2:
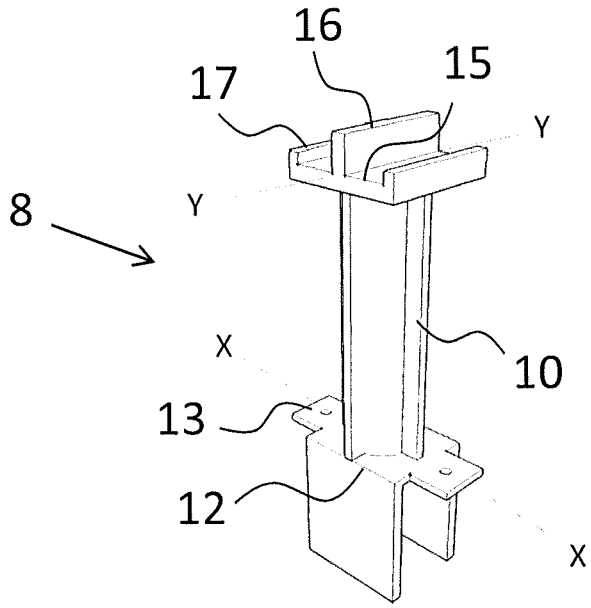
FIG. 2 is a perspective diagram of a leg component in accordance with the invention.

Referring to FIG. 2, the leg 8 comprises an elongate plastics member 10 having, at a lower end, a joist mount 12 and at the other, upper end, a platform mount 14. The leg 8 is formed as a single piece of material, although it could be made of separate parts if required.

The joist mount 12 has a fork-like shape in order to fit either side of an underlying joist of rectangular cross-section. Given the standardised dimensions of joists, it is straightforward to produce a mount whose inner recess will closely confirm with the joist width, thereby providing a secure fit when the fork is placed over the joist. A pair of opposed tabs 13 extending from the top of the mount 12 in a direction generally parallel to the joist axis X-X have respective holes provided for screwing or bolting the leg 8 to the joist for added stability.

The platform mount 14 comprises three parallel walls 16, 17 defining a pair of support surfaces 15 either side of the central wall 16. The central wall 16 is slightly taller than the outer walls 17. The walls 16, 17 and support surfaces 15 extend along an axis Y-Y substantially transverse to the joist axis X-X.

Figure 3:
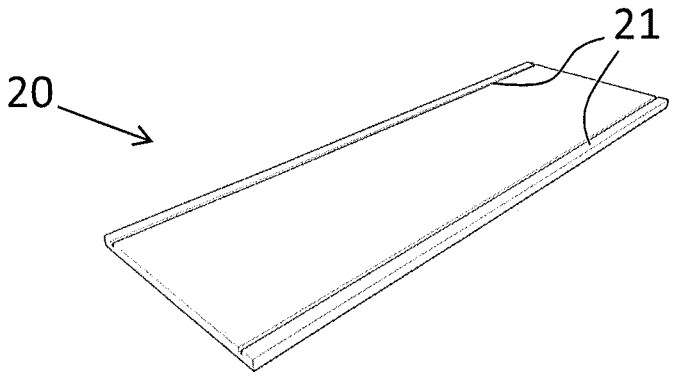
FIG. 3 is a board component in accordance with the invention.

Referring to FIG. 3, each rectangular board 20 is made of wood or wood-derived material such as plywood. Each board 20 is pre-cut to a standard size and, along both lengthwise edges, spaced inwards by a distance approximately equal to the width of one of the support surfaces 15, is a longitudinal groove 21. The width and depth of each groove 21 is substantially the same as the corresponding dimensions of one of the outer walls 17, enabling a tongue-and-groove (or, alternatively, a mortise) joint to be made when placing a board 20 onto the platform mount 14 of a leg 8. Optionally, adhesive can be pre-applied but this is by no means necessary.

Figure 4:
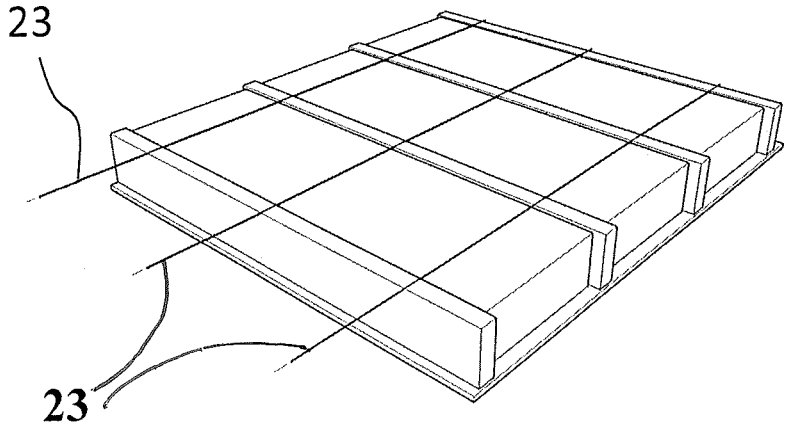
FIGS. 4-9 are perspective diagrams of an attic space with guidelines for installing apparatus according to the invention.
Figure 5:
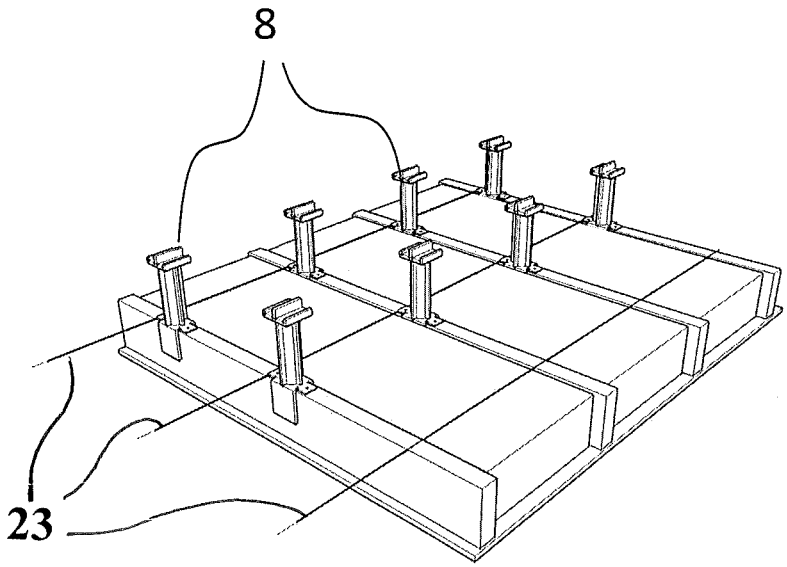

Referring to FIG. 4, in order to construct the raised support surface, one first sets out guidelines 23 based on the width of the insulation material to be rolled out. In this case, 400 mm centres are marked out. Referring to FIG. 5, first and second lines of, in this case, four legs 8 are attached to respective joists 4 adjacent one another. The legs 8 on each joist 4 are of course separated by the guidelines 23. Given the relative orientations of the joist and platform mounts 12, 14, the resulting support surfaces 15 extend generally transverse to the joist axes.

Figure 6:
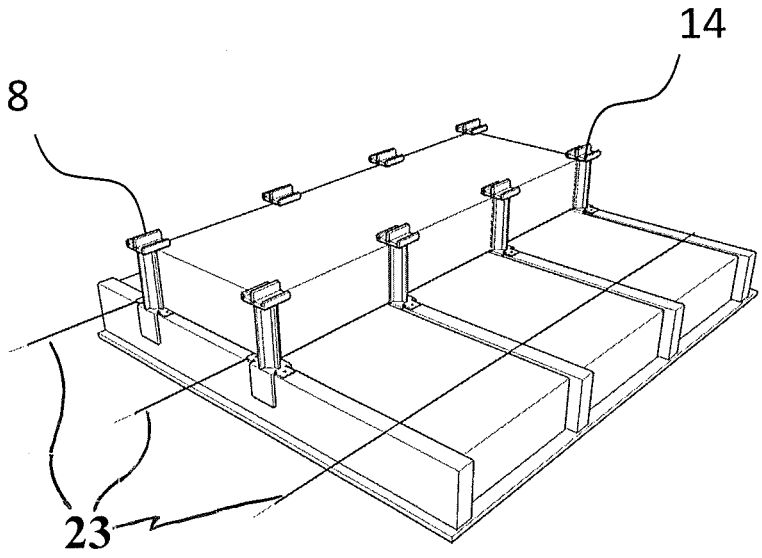
Figure 7:
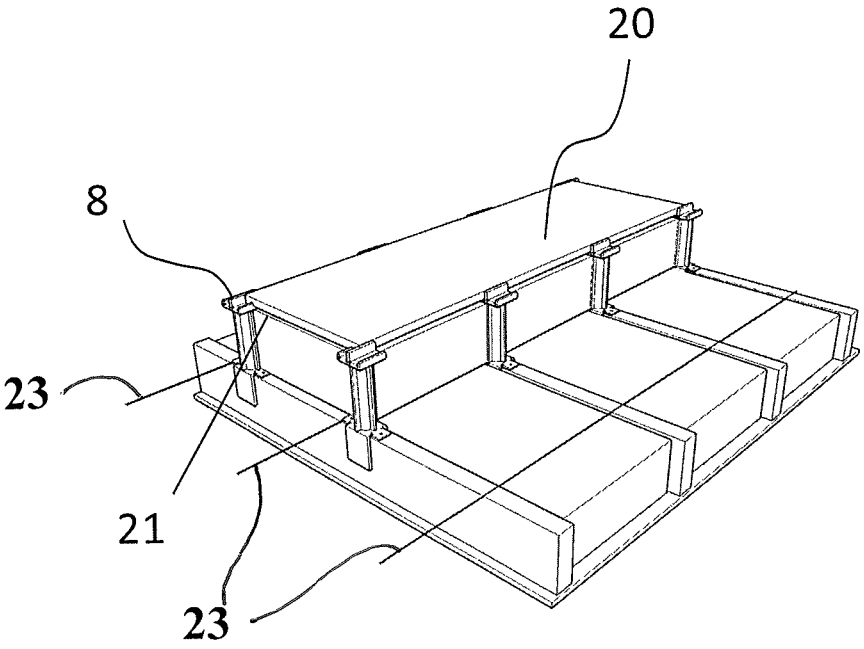

Referring to FIG. 6, the insulating material is rolled between the adjacent lines of legs 8, the upper surface being tucked beneath the platform mounts 14. Next, as shown in FIG. 7, a first rectangular board 20 is mounted onto eight underlying legs 8, specifically by locating the pre-cut grooves 21 over the tongues provided by the innermost outer walls 17 of each leg. As indicated in that Figure, inner wall 16 terminates substantially level with the upper surface of the board 20; the presence of the inner wall between adjacent boards minimises lateral movement but there should be no (or minimal) protrusion to avoid creating a trip hazard.

Figure 8:
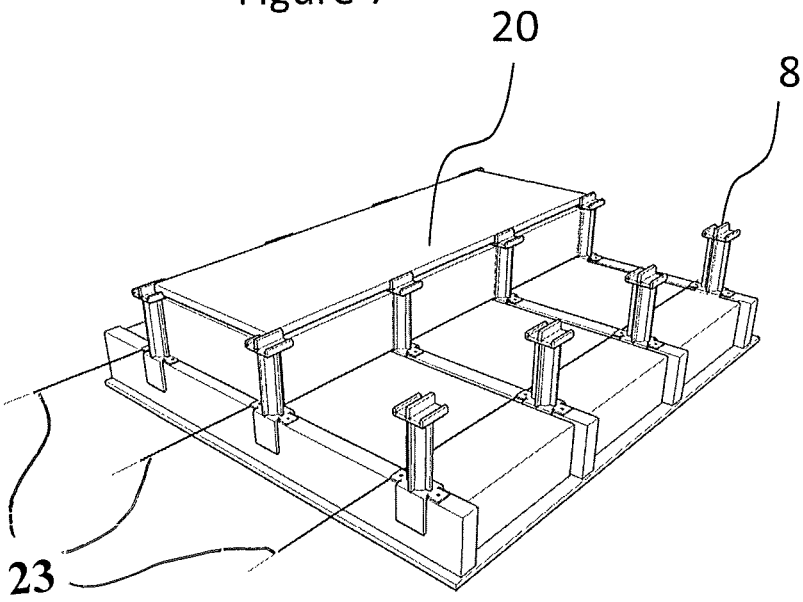
Figure 9:
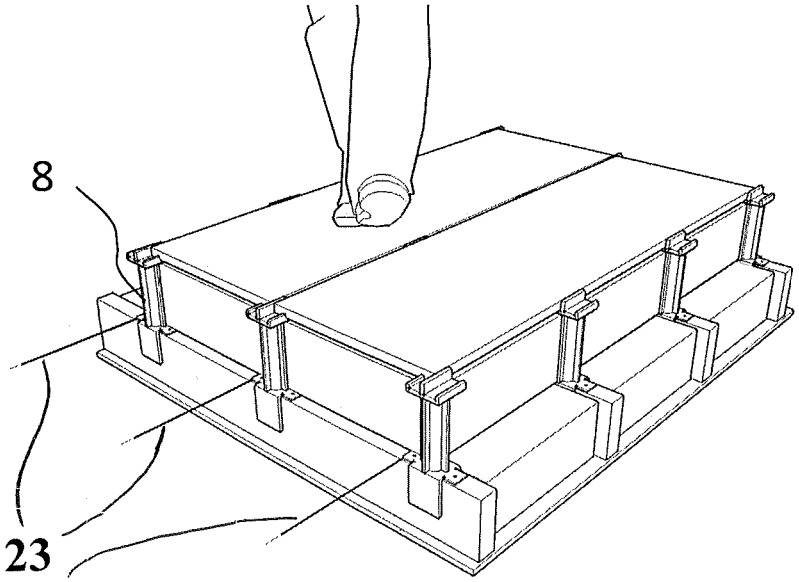
Figure 10:
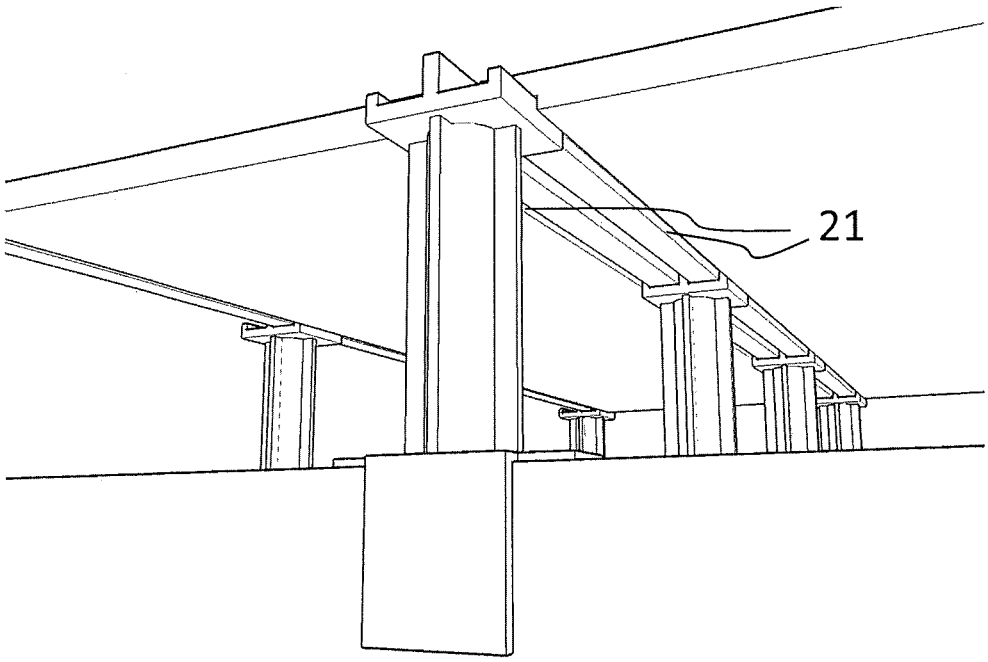
FIG. 10 is a perspective diagram of the underside of an installed apparatus according to the invention.

Referring to FIG. 8, a further row of four legs 8 is then fitted using the next adjacent guideline 23 and the process is repeated so that another board 20 can be fitted, as shown in FIG. 9. FIG. 10 shows the cavity that remains under the raised boards 20 connected in the manner described (for clarity, no insulating material is shown) and, in particular, it can be clearly seen how the outer walls 17 locate within the grooves 21 running transverse to the joists 4.

Figure 11:
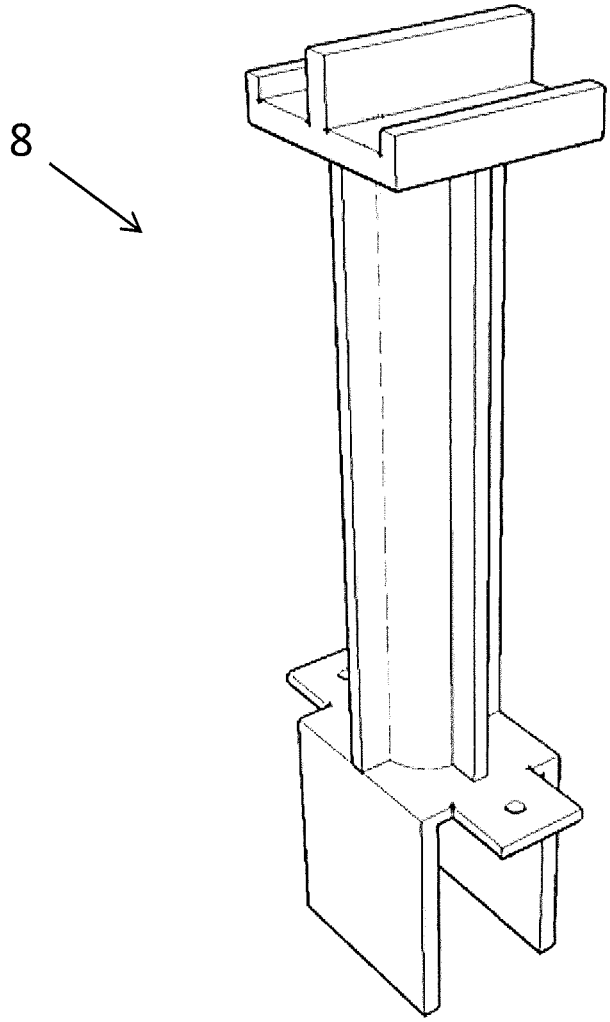
FIG. 11 is an enlarged perspective diagram of the leg component of FIG. 2, with typical dimensions shown.

FIG. 11 is a close-up view of the aforementioned leg 8 with dimensions shown for further information.

The resulting structure enables a raised platform or decking to be fitted (either on a 'new build' project or as a retro-fit system) relatively easily and cost-effectively using just two types of component. The structure enables the laying of at least two layers of insulating material whilst maintaining a storage or walking platform in spite of the joists being hidden.

A second embodiment will now be described with reference to FIGS. 12 to 20.

Figure 12:
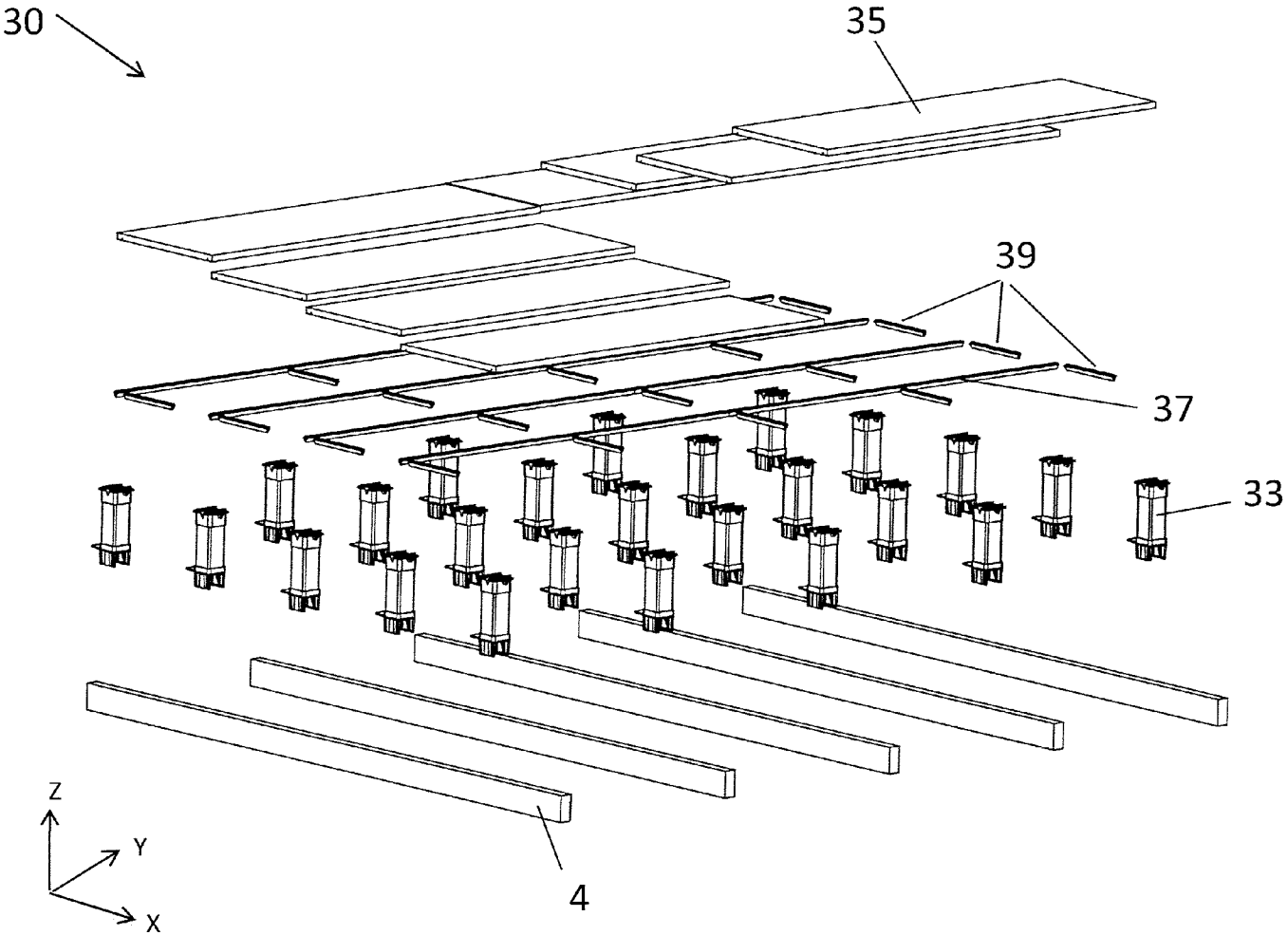
FIG. 12 is an exploded perspective view of a raised platform system in accordance with a second embodiment of the invention.

Referring to FIG. 12, the second embodiment comprises a set of legs 33 and boards 35 provided together with further components in the form of transverse arms 37 and, optionally, spars 39. When constructed in the manner to be described, this raised platform system 30 provides a framework or lattice structure, as generally depicted in exploded form in the Figure.

Each component will now be described in detail.

Figure 13:
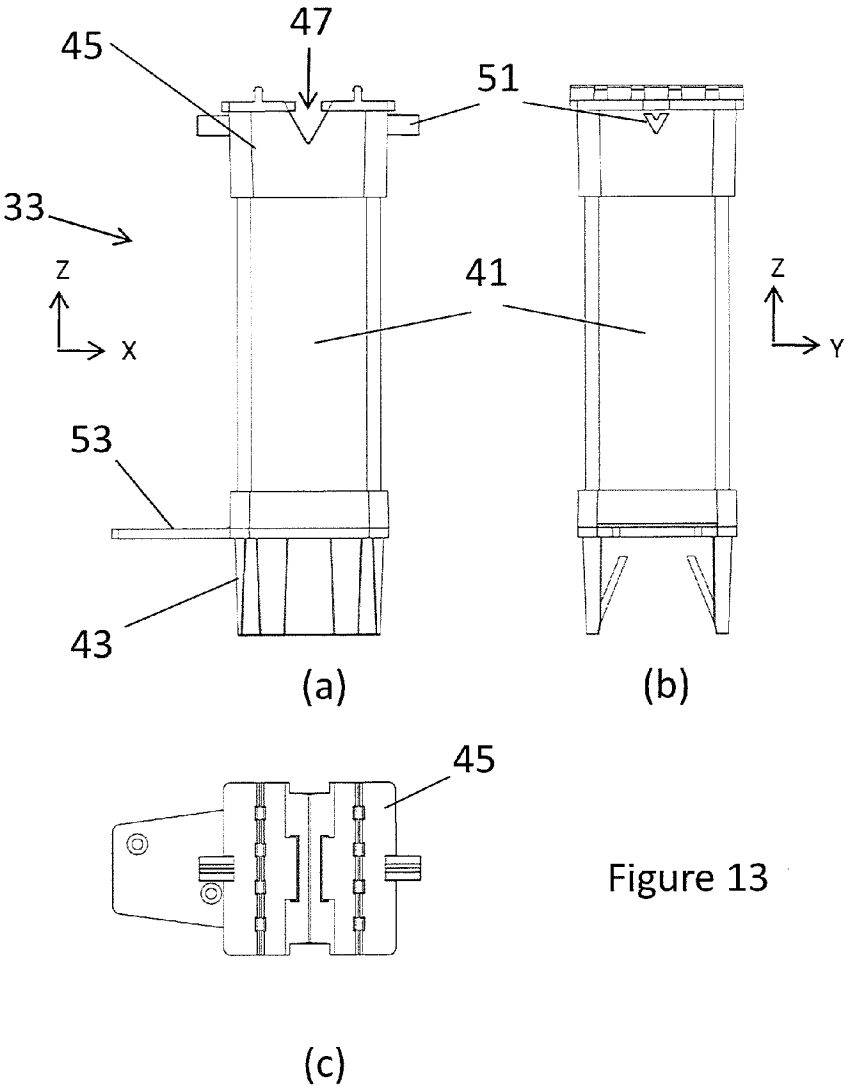
FIGS. 13(*a*)-(*c*) show different views of a leg component in accordance with the second embodiment.

Referring to FIG. 13(*a*)-(*c*), each leg 33 comprises an elongate structure made of three separable parts. The major part is an elongate hollow post 41 made of plastics material of square/rectangular cross section. Attached to the top of the post 41 is a plastics support cap 45 (hereafter simply "cap") and, attached to the bottom is a joist mount 43.

Briefly, it will be seen from this Figure that the cap 45 includes a V-shaped groove 47 recessed into its upper surface, below its upper support level, and which passes from one side to the other, including through opposed lateral faces of the cap. On the transverse faces are provided a pair of opposed pegs 51.

Figure 14:
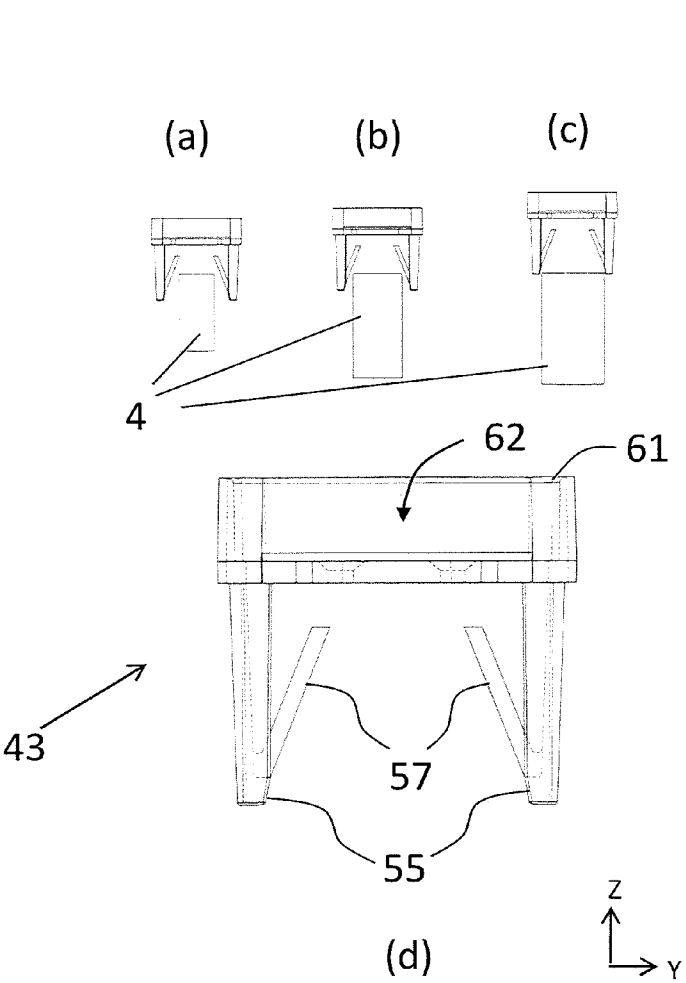
FIGS. 14 (*a*)-(*d*) are side views of a joist mount part of the leg component in FIGS. 13(*a*)-(*c*)

Referring to FIGS. 14(*a*)-(*d*), a more detailed view of the joist mount 43 is shown. The mount 43 comprises a plastics component comprising a hollow base 61 of square/rectangular form defining a recessed interior 62 whose outer walls conform to and engage with the outer wall of the post 41. Extending below the base 61 is a pair of lateral arms 55, tapering slightly inwards. From the end of each arm 55, extending upwards back towards the base 61, is a resilient plastics tab 57, both tabs providing a pair of jaws which, in use, engage and grip the underlying joist 4. As shown in the schematics depicted above the main diagram, the jaws 57 allow the mount 43 to fit over (the lateral sides of) joists 4 of varying widths whilst remaining stable.

Figure 15:
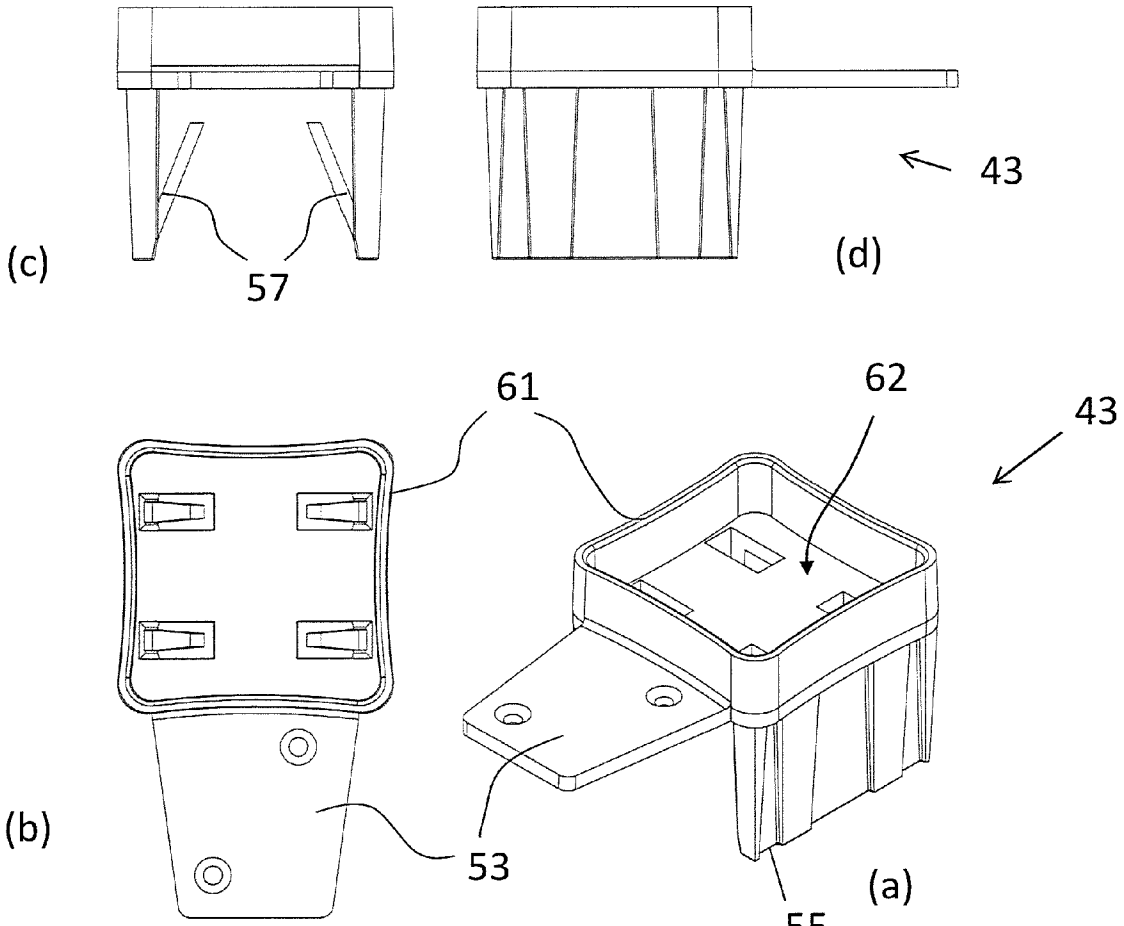
FIGS. 15(*a*)-(*d*) show different views of the joist mount part of FIGS. 14(*a*)-(*d*)

Referring to FIGS. 15(*a*)-(*d*), the joist mount 43 also includes a cantilevered plate 53, extending from one side thereof in alignment with the arms 55, that includes a pair of holes enabling the mount, when located over a joist 4, to be screwed to the joist to provide additional stability. One or more holes is/are suitable.

Figure 16:
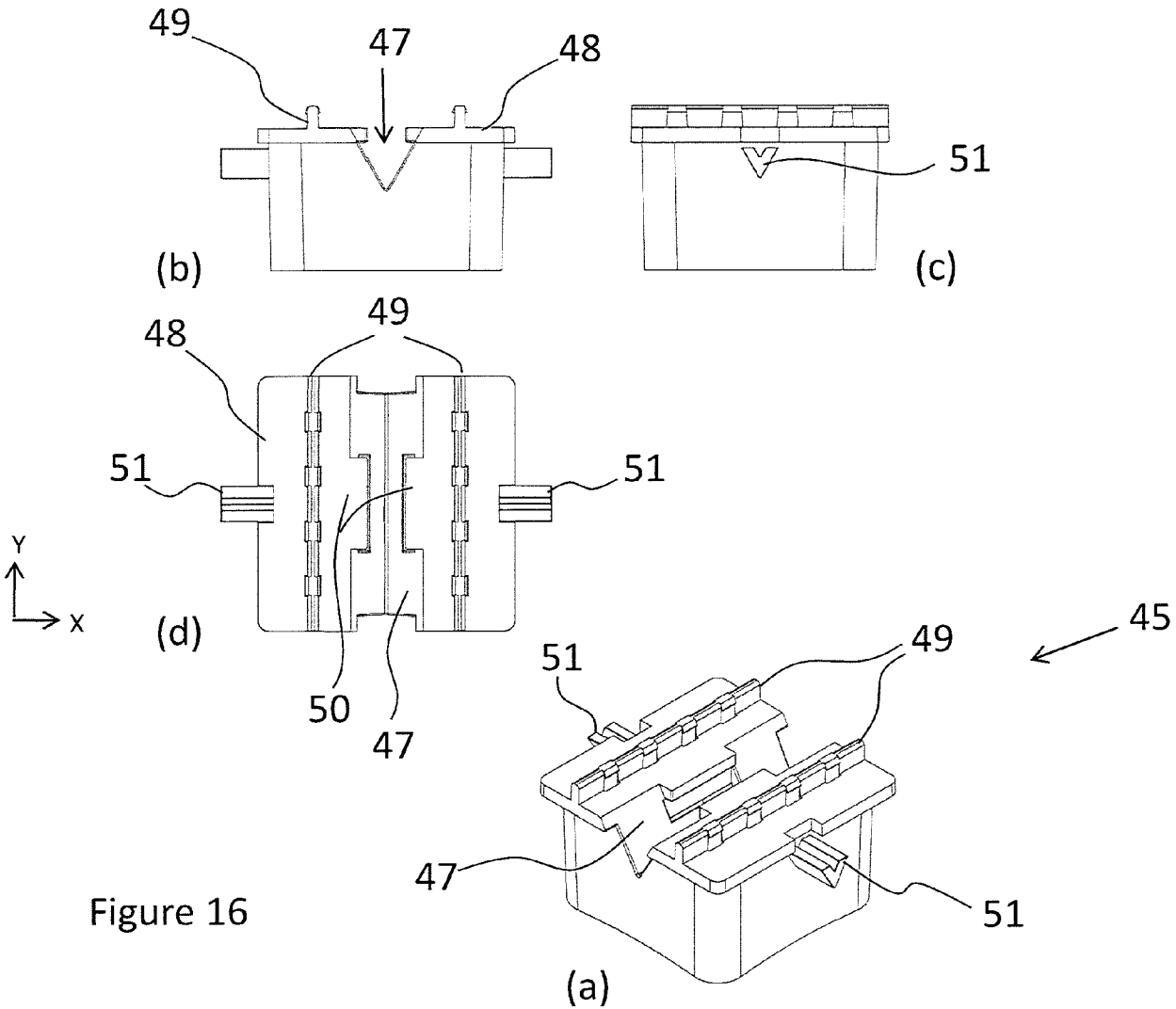
FIGS. 16(*a*)-(*d*) show different views of a platform mount part used in the second embodiment.

Referring to FIGS. 16(*a*)-(*d*), as indicated above, the cap 45 is molded to provide a particular predefined shape enabling the arm components 37, 39 to be connected to it and for supporting the boards above it. The upper surface of the cap 45 comprises a horizontal platform 48 having the V-shaped groove 47 recessed within it extending from one side to the other. A pair of retaining tabs 50 extend partly over the groove 47 in the central region of the platform 48. A pair of parallel walls 49 extend upwards from the platform 48, the purpose of each being to engage the underside groove of a board 35, in much the same way as the outer walls 17 of the first embodiment.

On the other, transverse sides of the cap 45, the pair of opposed pegs 51 protrude from the cap surface. The profile of each peg 51 is approximately triangular.

Returning to FIG. 13, it will be seen that the mount 43 and cap 45 are arranged, in use, to be connected to the post 41 in a particular orientation relative to one another; the groove 47 is arranged to run along an axis transverse to that of the groove between jaws 55, 57. The Figures show orthogonal X, Y, Z axes to give a general indication of the relative orientations with respect to joists 4.

Figure 17:
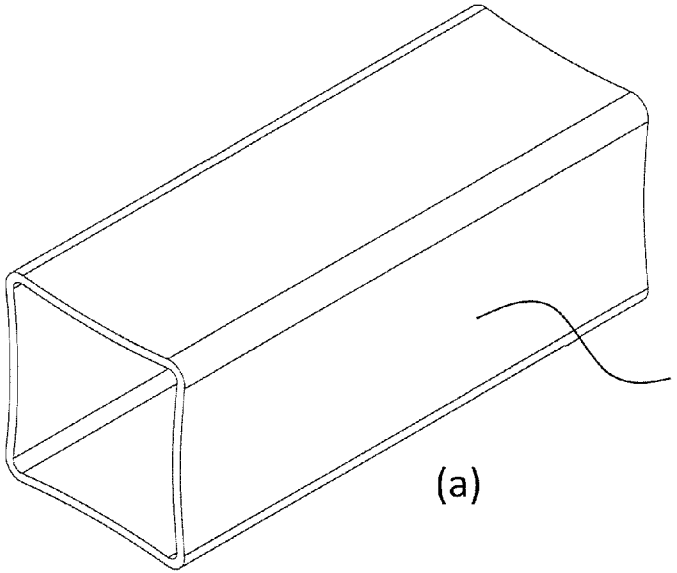
FIGS. 17(*a*)-(*b*) show perspective and sectional views of a post part of the leg component shown in FIGS. 13(*a*)-(*c*)
Figure 17:
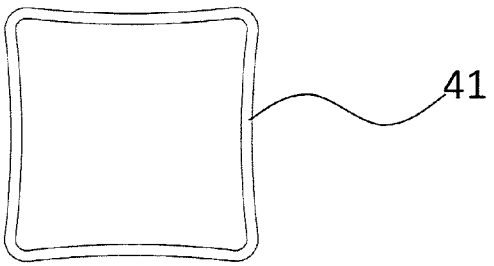

Referring to FIGS. 17(*a*)-(*b*), the post 41 is shown in perspective and sectional views.

Figure 18:
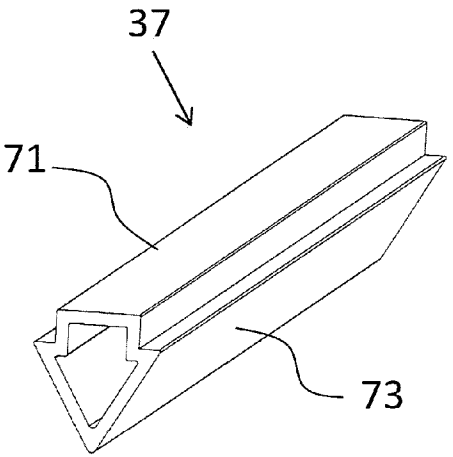
FIGS. 18(*a*)-(*b*) show perspective and sectional views of a transverse arm part forming part of the second embodiment.
Figure 18:
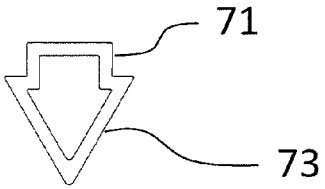

FIGS. 18(*a*)-(*b*) show perspective and sectional views of one of the transverse arms 37; it will be seen that each arm 37 has an arrow-like cross-section with an upwardly projecting wall 71 and a lower triangular part 73. The triangular part 73 is shaped so as to conform with the groove shape 47 in the cap 45, the wall 73 being narrow enough to pass between tabs 50 and projecting proud of the platform 48.

Figure 19:
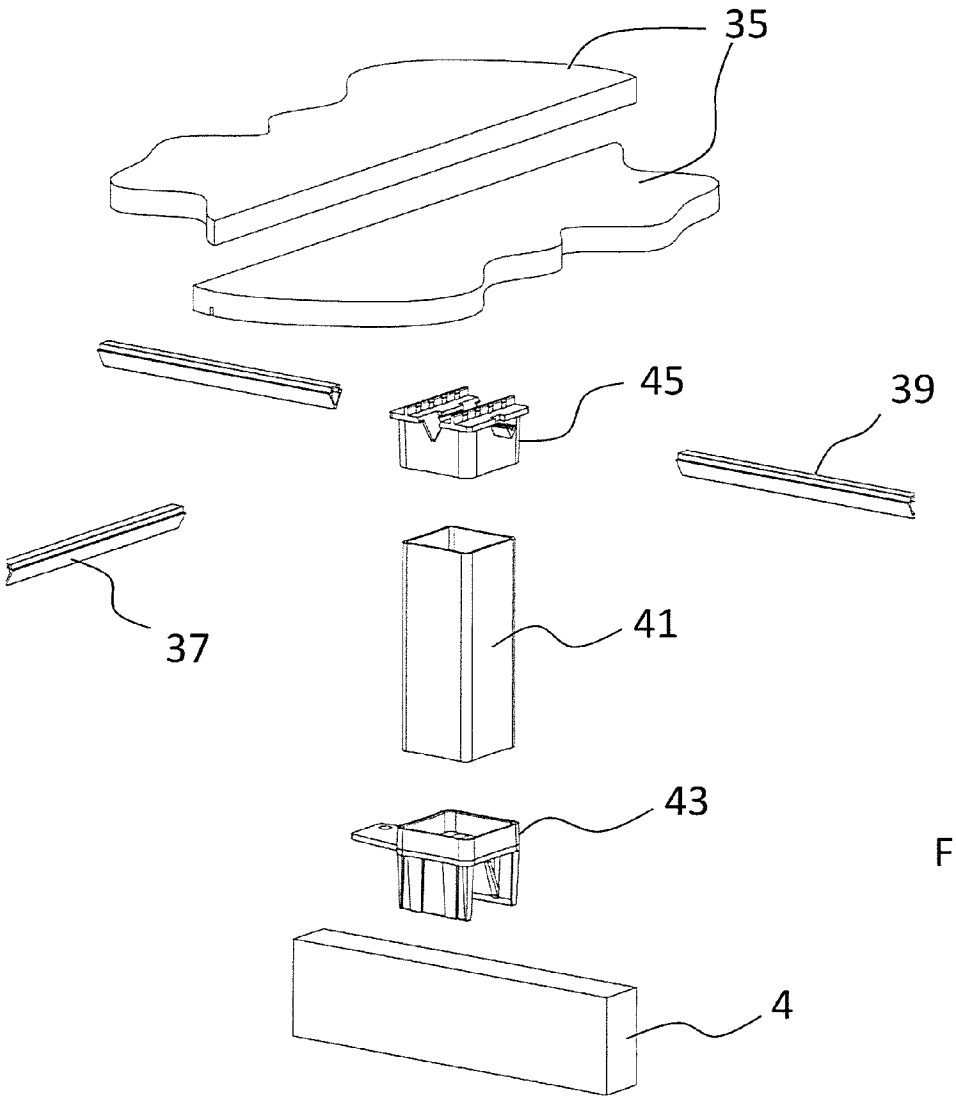
FIG. 19 is a partial exploded perspective drawing showing how various components forming the second embodiment are connected together.

Referring to FIG. 19, the cap 45 enables one or more arms 37, 39 to be connected into either the groove 47 or to one of the pegs 51 in order to provide additional support beneath the boards 35. A transverse arm 37 will provide, as the name suggests, support in the direction generally transverse to the joists 4. The spars 39, on the other hand, run generally parallel to the joists 4.

Although not shown in detail in the Figures, the spars 39 have either the same, or a similar cross-section, to that of the transverse arms 37 such that the ends can connect to the pegs 51. Both types can be made out of a plastics or metal material, for example steel or aluminium. As indicated in FIG. 12, the length of the each transverse arm 37 is greater than the width between adjacent joists 4; in fact each arm preferably extends from a first joist to a third joist via an intermediate joist, as enabled by the V-shaped groove 47 in each cap 45. The spars 39, which are considered optional, need not be as long as the transverse arms 37. Their role is to add extra support underneath the boards, in addition to the transverse arms 37, in the orthogonal direction.

The generally orthogonal arrangement of legs 33 and arms 37, 39 whilst preferable, is not essential. Adjustments and variations are possible; however, if rectangular boards 35 are to be used, this arrangement is the preferred choice.

By making the spars 39 a predetermined length, they can be used to assist spacing apart the legs 33 on each joist 4. The fitter need only mark out a first row of legs 33, and then use the spars 39 extending parallel over the joists 4 to indicate where the next row of legs should be fitted.

Figure 20:
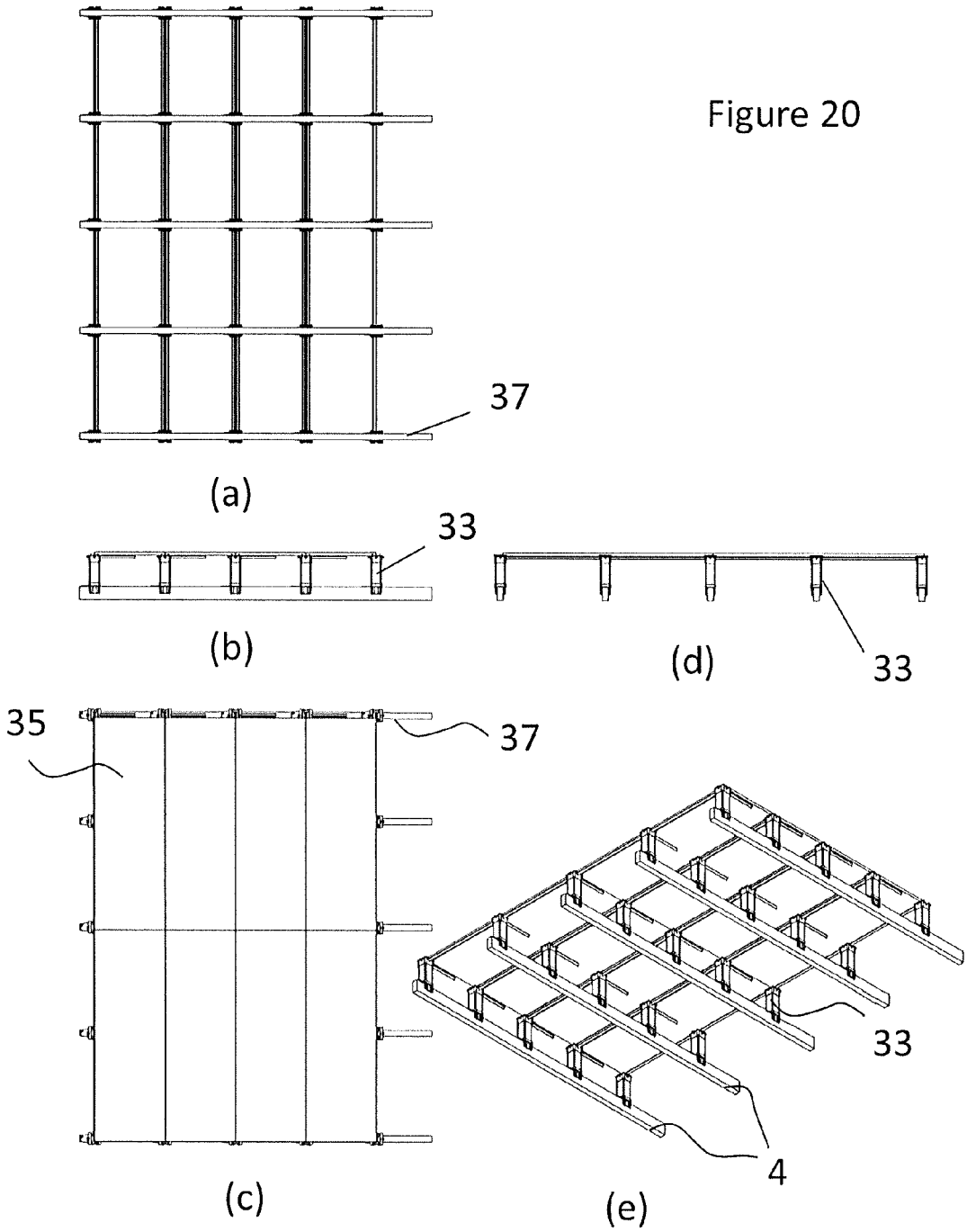
FIGS. 20(*a*)-(*e*) show different views of a constructed raised platform system according to the second embodiment.

In order to construct the raised support surface, generally depicted in FIGS. 20(*a*)-(*e*), one first sets out guidelines 23 based on the width of the insulation material to be rolled out. In this case, 400 mm centres are marked out. Referring to FIG. 5, first and second lines of, in this case, four legs 8 are attached to respective joists 4 adjacent one another. The legs 8 on each joist 4 are of course separated by the guidelines 23. Given the relative orientations of the joist and platform mounts 12, 14, the resulting support surfaces 15 extend generally transverse to the joist axes.

An additional fixing or clip may be provided to enable the boards to be secured to the transverse arms 37. This may comprise providing a groove or continuous slot in each transverse arm 37 and a metal clip that would be pushed down vertically between the boards to engage into the slot. The metal clip could, for example, be T-shaped.

Further, an interconnecting arm may be provided to join together axially aligned transverse arms 37. This interconnection may comprise a plug or tube that, for example, could push into or over one end of each adjacent arm 37. This may be important since the spacing between joists cannot be predicted and so it is not always the case that the transverse arms 37 will meet directly over a leg 33.

Referring to FIGS. 21 to 26, a third embodiment will now be described. This embodiment is similar to the first in that it does not require the use of transverse arms or spars; it offers further advantages in that it does not require the legs to be accurately spaced apart in order to fix the boards over the parallel walls 39, as is the case in the second embodiment.

Figure 21:
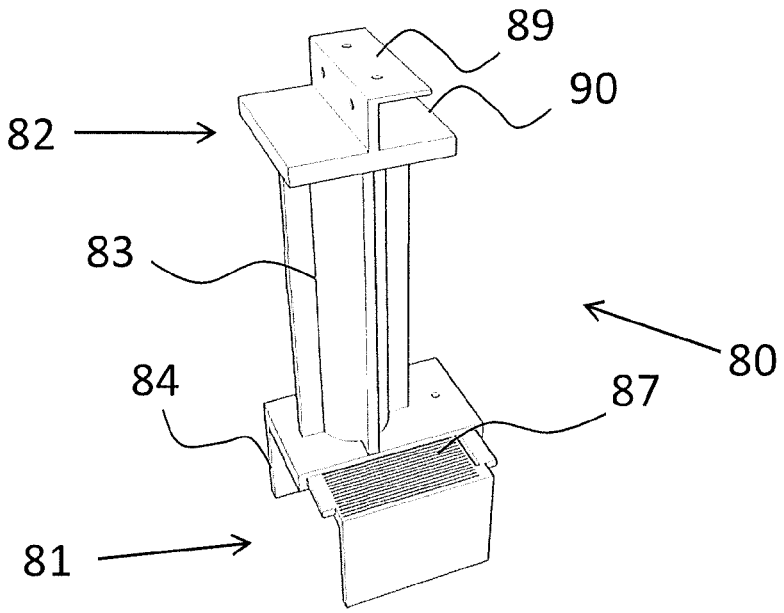
FIG. 21 shows a perspective view of a leg employed in a third embodiment.
Figure 22:
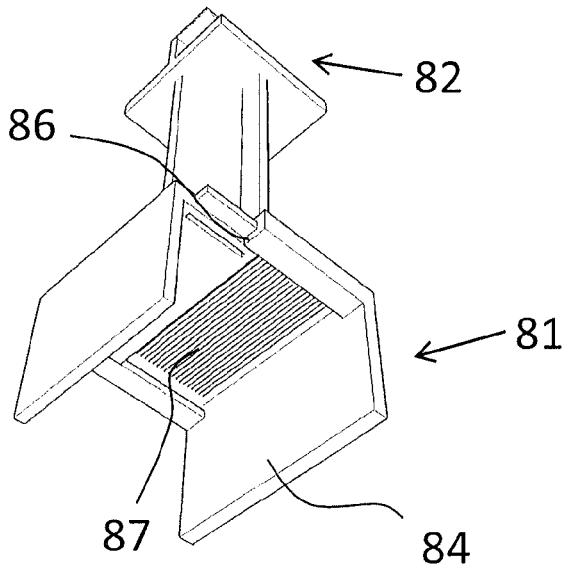
FIG. 22 shows a perspective view, from underneath, of the leg shown in FIG. 21.
Figure 23:
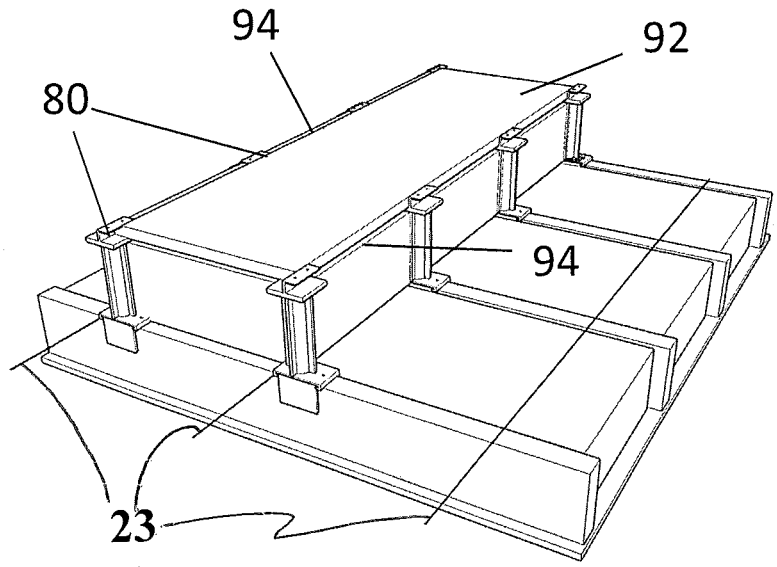
FIGS. 23-26 are perspective diagrams of an attic space with guidelines for installing apparatus based on the third embodiment.
Figure 24:
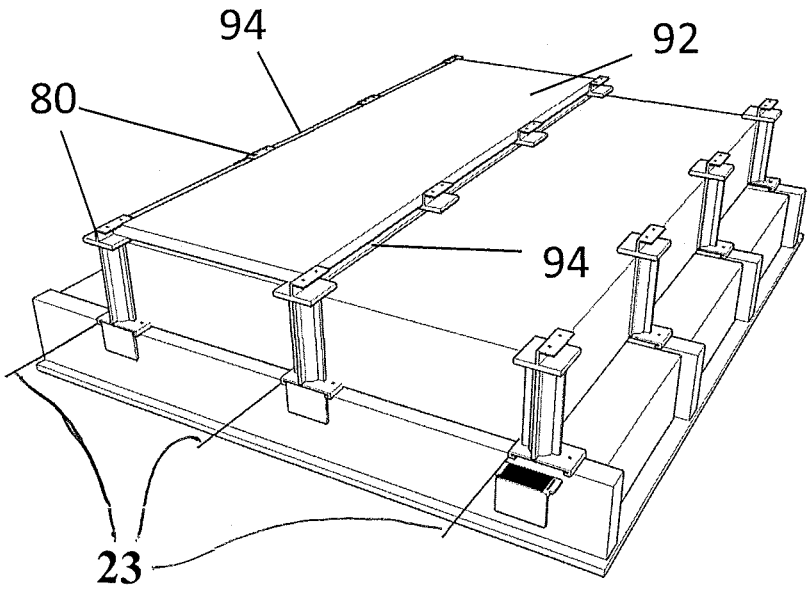

FIGS. 21 and 22 shows a leg 80 for use in this third embodiment. The leg 80 is an elongate plastics member or post 83 having, at a lower end, a joist mount 81 and at the other, upper end, a platform mount 82.

The joist mount 81 comprises an adjustable bracket made up of an integral L-shaped member 84 which has a pair of inner channels 86 and a separate, slidable L-shaped member 87 the edges of which engage within the channels to allow adjustment of the mounting channel defined between jaws of the opposed L-shaped members. Each of the L-shaped members 84, 87 have a friction or sawtooth-type surface 87 which together allow the L-shaped members to be fixed relative to each other; relative adjustment is achieved by applying an external force to one or both of the members to overcome the inherent resistance of the opposing sawtooth surfaces.

The platform mount 82 comprises a first horizontal surface 88, from which projects an inverted L bracket 89, approximately half-way along. On the opposite side of the L-shaped bracket 89 is a second horizontal surface 90.

Referring now to FIGS. 23 to 26, the leg 80 is preferably used with boards 92 that differ from those described previously in that, rather than having a longitudinal slot, they have longitudinal grooves 94 formed along the lateral sides.

In order to fit the boards 92 to the legs, one first follows the procedure described with reference to FIGS. 4 to 6 above, although using the new legs 80. Referring back to FIGS. 23 to 26, a board 92 is laid by inserting one lateral edge under the inverted L bracket 89 of each spaced apart leg 80 on the first row of joists, so that the bracket part extends into the groove 94. The opposite edge is then lowered onto the first horizontal surface 88 of each leg 80 in the next row. The board 92 is then screwed vertically to the legs 80 on the left hand side and horizontally to the legs on the right hand side, using the holes provided.

Figure 25:
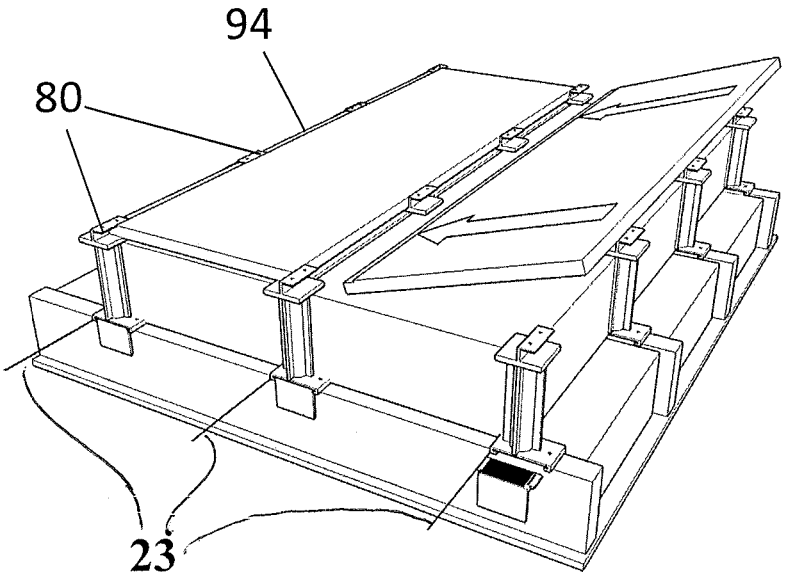
Figure 26:
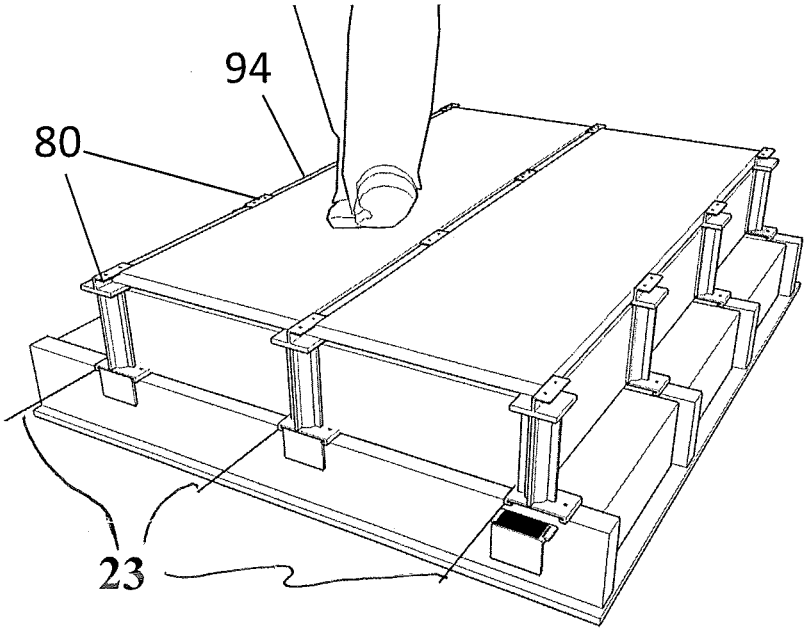

FIGS. 25 and 26 show the next board 92 being laid and the resulting surface.

A common feature of each embodiments is that they do not require there to be a fixed and predetermined distance between adjacent joists 4, which in practice will vary. Joists are commonly spaced on 400 mm, 500 mm or 600 mm centres and, even then, there will be small variations either side of the stated figure. In a system where the boards are required to lie directly over two adjacent joists, a range of different board widths would have to be made available to ensure the lateral edges are supported. The above three embodiments, however, promote the use of boards which lie transverse to the direction of the joists, and whose length is such as to span two or more joists. The upper support surfaces of each leg engage or support the boards using at least a groove arrangement aligned or extending generally transverse to the direction of the joists, thereby defining the laying direction and allowing adjustment of a board's position along this transverse direction. There is no requirement for a board to be of a particular width or length and the system is totally flexible. The first and second embodiments use a tongue (two upstanding from the support surface) and groove (two in each board) arrangement; the third embodiment employs a tongue portion formed along the lengthwise edge of each board arranged to engage within the channel defined by the L-shaped bracket 89.

The invention claimed is:

1. An apparatus for providing a platform area in an attic having a plurality of generally parallel joists, the apparatus comprising:

a plurality of legs, each of said plurality of legs having a first end and a second end, and having a joist mounting at said first end comprising a pair of jaws configured to engage only one joist of the plurality of generally parallel joists, a platform support at said second end, the platform support comprising two upstanding substantially parallel end walls defining support surfaces, a central wall arranged in between the two end walls, and an arm mounting at said second end, the arm mounting being capable of providing underlying support to a board of said plurality of boards across a space between two adjacent joists of said plurality of parallel joists;

a plurality of boards for being supported by the support surfaces of the platform supports of at least two of the plurality of legs when mounted on different joists of the plurality of generally parallel joists, thereby to provide a raised platform over the joists; and a plurality of longitudinal arms each for connection to the arm mountings of at least two of the plurality of legs so as to provide underlying support to at least one of the plurality of boards.

2. The apparatus according to claim 1, wherein the arm mounting is adjacent a level of the platform support to provide underlying support to a board of said plurality of boards.

3. The apparatus according to claim 1, wherein the arm mounting comprises an aperture, recess or niche and the arm has a length sufficient to span a distance of more than said space by means of passing through the aperture, recess or niche of an intermediate leg of said plurality of legs.

4. The apparatus according to claim 1, wherein the arm mounting of each of said legs is arranged such that each of the arms extends substantially transverse to the joists.

5. The apparatus according to claim 1, wherein each of said plurality of longitudinal arms comprises a tongue portion protruding upwards along at least part of a length of each of said longitudinal arms in order to engage a groove formed in at least one board of the plurality of boards.

6. The apparatus according to claim 5, wherein each of said plurality of longitudinal arm supports at least two boards of the plurality of boards, the tongue portion engaging a groove formed along the edge of each of said boards extending transverse to the joists.

7. The apparatus according to claim 1, wherein each of said legs further comprises a spar mounting arranged generally parallel to the joists, and into which a longitudinal spar can be connected to provide additional underlying support to or at least one of the plurality of boards.

8. The apparatus according to claim 1, wherein the jaws are provided by upwardly projecting tabs within a U-shaped clamp.

9. The apparatus according to claim 1, wherein the joist mounting further comprises means for additionally screwing or bolting the joist mounting to a joist of said plurality of joists.

10. The apparatus according to claim 1, wherein the joist mounting and said platform support are provided as separate components separated by a longitudinal post.

11. The apparatus according to claim 1, wherein each of the plurality of boards includes at least one longitudinal groove adapted to receive one of the upstanding substantially parallel walls on either side of the central wall.

12. An apparatus for providing a raised platform in an attic having a plurality of generally parallel joists, the apparatus comprising a set of components made up of:

(i) a plurality of legs, each of the legs for connection to only one underlying joist of the plurality of joists by means of a pair of jaws configured to engage only one joist of the plurality of generally parallel joists, each of the legs having a platform support that comprises two upstanding substantially parallel end walls defining support surfaces, a central wall arranged in between the two end walls, and an arm mounting located at a level of the platform support, the arm mounting being capable of providing underlying support to a board of said plurality of boards across a space between two adjacent joists of said plurality parallel joists, (ii) a plurality of detachable arms, each of the detachable arms for connection between two or more of the legs on different joists of the plurality of joists, and (iii) a plurality of boards for laying over the support surfaces provided by the legs, thereby to provide a raised platform over the joists;

wherein the arm mounting of each of the plurality of legs is arranged such that each of the arms extends substantially transverse to the joists.

* * * * *